United States Patent [19]

Khanna et al.

[11] 4,436,648

[45] Mar. 13, 1984

[54] ELECTRICALLY CONDUCTING THERMOPLASTIC MATERIAL, ITS MANUFACTURE, AND RESULTING ARTICLE

[75] Inventors: Sarwan K. Khanna, Carmel; Satya P. Khanna, Indianapolis, both of Ind.

[73] Assignee: Bell Telephone Laboratories, Incorporated, Murray Hill, N.J.

[21] Appl. No.: 219,260

[22] Filed: Dec. 22, 1980

[51] Int. Cl.[3] ..... H01B 1/06

[52] U.S. Cl. ..... 252/511; 179/111 E; 307/400

[58] Field of Search ....., 252/511; 179/111 R, 179/111 E; 524/495, 496; 29/592 E; 307/88 ET; 264/104, 105

[56] References Cited

U.S. PATENT DOCUMENTS 3,612,778 10/1971 Murphy ..... 179/111

FOREIGN PATENT DOCUMENTS 52-124043 9/1977 Japan .

2000158 1/1979 United Kingdom .

*Primary Examiner*—Josephine Barr

*Attorney, Agent, or Firm*—Peter A. Businger

[57] ABSTRACT

ABS thermoplastic material is rendered electrically conducting by the inclusion of carbon particles. When manufactured by a process of dry mixing of ingredients, melting, and molding, the material has desirably low sheet resistance even at relatively low levels of carbon content (as is desirable in the interest of plastic formability). The new material may be used in the manufacture of electret microphones.

5 Claims, 4 Drawing Figures

ELECTRICALLY CONDUCTING THERMOPLASTIC MATERIAL, ITS MANUFACTURE, AND RESULTING ARTICLE

TECHNICAL FIELD

The invention is concerned with electrically conducting materials and, more particularly, with electrically conducting, easily molded plastic materials, their manufacture, and their use.

BACKGROUND OF THE INVENTION

Thermoplastic materials such as, e.g., polyvinyl chloride (PVC) and acrylonitrile butadiene styrene copolymer (ABS) typically have high electrical resistance and, accordingly, may be used as electrically insulating components, e.g., in electrical apparatus, appliances, and devices of everyday use. In other applications, where electrical conductivity is required, plastic materials may be used with a metallic coating such as, e.g., a coating of copper, nickel, or chromium. Such electrically conducting coatings may be deposited by vapor deposition or, more typically, by a process of electroplating which may be preceded by a step of electroless plating so as to provide for an electrically conducting surface for subsequent electroplating. Alternatively, electroplating may be directly on a plastic material which has been rendered electrically conducting in bulk by the inclusion of a conductive additive such as, e.g., carbon black; such methods are the subject of recent disclosures such as Japanese patent disclosure 1977-124043 by H. Kuramochi et al., dated Sept. 18, 1977; Japanese patent disclosure 1978-96070 by H. Sakano et al., dated Aug. 22, 1978; Japanese patent disclosure 1978-96071 by H. Sakano et al., dated Aug. 22, 1978; and U.K. patent application GB No. 2,000,158 A by H. Sakano et al., published Jan. 4, 1979. Carbon black has also been used as a conductive ingredient in molded recording discs as disclosed in U.S. Pat. No. 4,151,132, issued Apr. 24, 1979 to S. K. Khanna.

Plated plastic parts are used, e.g., in acoustoelectric and electroacoustic transducers such as, e.g., condenser microphones, electrostatic speakers, and vibration transducers. Such transducers typically have an "electret" (electrically polarized dielectric) diaphragm, a facing "backplate" component, and, conveniently, a "clamping plate" component; specific designs of electret transducers are disclosed in U.S. Pat. No. 3,612,778, issued Apr. 3, 1970 to P. V. Murphy; in U.S. Pat. No. 4,046,974, issued Sept. 6, 1977 to J. C. Baumhauer et al.; and in the paper by S. P. Khanna et al., "The EL2 Electret Transmitter: Technology Development", *Bell System Technical Journal,* Vol. 59 (1980), pp. 745–762.

SUMMARY OF THE INVENTION

In accordance with the invention, a composition comprising an ABS plastic material and carbon particles has mechanical and electrical properties which render it suitable for molding applications. Such composition is manufactured by a process including dry mixing of plastic and conducting ingredients, melting of the mixture, and forming into desired shape. The composition has high electrical conductivity and high formability.

The use of compositions in accordance with the invention in the manufacture of electret microphone backplates and clamping plates obviates the need for costly surface metallization by plating.

DETAILED DESCRIPTION

Electrically conducting thermoplastic parts are made from a material which includes an acrylonitrile butadiene styrene copolymer resin (customarily called ABS for short) and carbon particles. To avoid undue brittleness on the one hand and softness on the other, such material preferably includes butadiene rubber in an amount in the range of 10–14 weight percent of the ABS resin.

The material may also include small amounts of unintentionally present impurities as well as intentional additives such as, e.g., lubricant and flame retardant ingredients. The material preferably comprises a combined amount of at least approximately 98 weight percent ABS and carbon particles in combination, carbon particles being included in a preferred amount of 5–20 weight percent and preferably 7–12 weight percent of the material. (Amounts of carbon particles below 5 percent are considered to result in insufficient conductivity for purposes of the invention; amounts greater than 20 percent are considered detrimental to formability.) Carbon particles may be in the form of "carbon black" having surface area which is at least 500 $m^2/gm$.

Processing in accordance with the invention is by dry mixing of measured amounts of constituent ingredients ABS and carbon particles, melting, and molding. Typical processing is as follows: Measured amounts of ABS powder and carbon black are mixed intimately, a lubricant such as, e.g., oil devasilina is added, the resulting mixture is melted by heating, the melt is poured, and the solidifying material is chopped into granules. Molding is by reheating the material and then pushing it into a die. ABS resin and carbon ingredients preferably contain less than 0.01 percent moisture; this may be assured by a drying step prior to measuring or mixing.

Carbon loss in the course of mixing, melting, pouring, chopping, and reheating is considered to be minimal. Accordingly, the proportion of measured ingredients is essentially maintained in a molded article.

Final shape of an article of manufacture may preferably be as molded; however, machining after molding is not precluded. In the latter case, in the interests of stress relaxation and ultimate dimensional stability of a formed part, a step of annealing is desirable prior to machining. Electrically conducting ABS, in accordance with the invention, has thermal expansion properties which are compatible with those of nonconducting ABS; accordingly, composite parts may be made including conducting and nonconducting components. This may be achieved, e.g., by separate molding or machining of parts, followed by joining, e.g., by bonding or snap-fitting. Alternatively, "two-shot" molding may be used, e.g., by first injecting into a mold a measured amount of nonconducting ABS, followed by an amount of conducting ABS in accordance with the invention.

Figure 1:
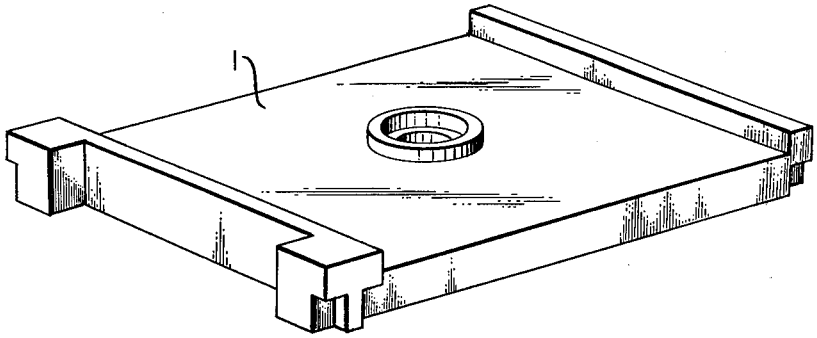
FIG. 1 shows, enlarged, a molded part which, in accordance with the invention, can serve as a clamping plate in an electret microphone cartridge.
Figure 2:
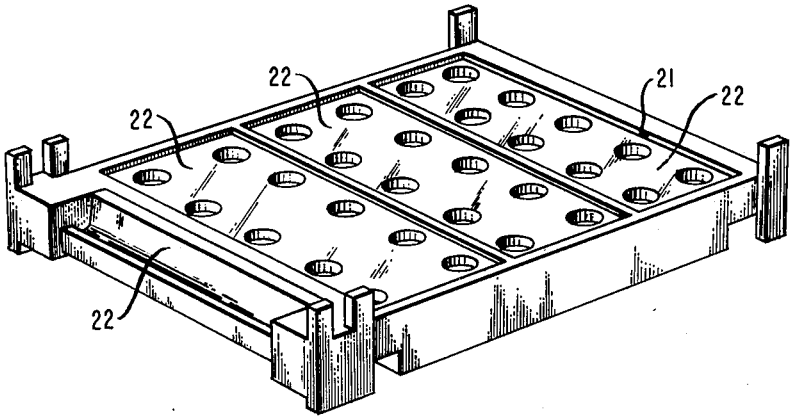
FIG. 2 shows, enlarged, a molded part which, in accordance with the invention, can serve as a backplate in an electret microphone cartridge.

Plastic parts comprising electrically conducting ABS in accordance with the invention are depicted in FIGS. 1 and 2. FIG. 1 shows clamping plate 1 of an electret microphone, molded in one piece from conducting ABS.

FIG. 2 shows a backplate of an electret microphone consisting of a nonconducting portion 21 and a conducting portion 22. Portions 21 and 22 may be fabricated separately and fitted together; alternatively, two-shot molding may be employed to produce the article comprising such two portions.

Figure 3:
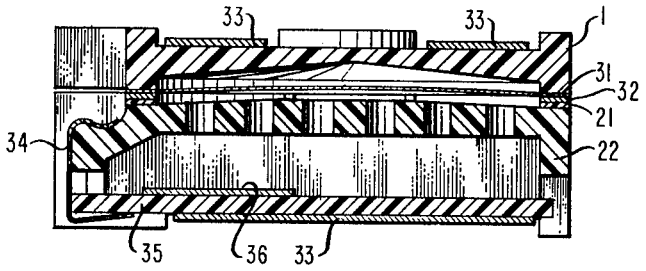
FIG. 3 shows, in enlarged cross section, an electret microphone cartridge in accordance with the invention.

FIG. 3 shows plastic components of the invention as assembled in an electret microphone. Shown are clamping plate 1, a backplate having a nonconducting portion 21 and a conducting portion 22, diaphragm 31, gasket 32, clamp 33, contact spring 34, circuit support member 35, and preamplifier circuit 36.

As a result of processing in accordance with the invention, molded parts have desirably low sheet resistance as measured in units of ohm or, more descriptively, of "ohm per square"; sheet resistance of a material is defined as the resistivity of a sheet having unit thickness. Low sheet resistance is considered to be a result of processing in accordance with the invention and may be ascribed to a particularly even distribution of carbon particles in the ABS resin, to the minimization of carbon cluster formation, and/or to the breaking up of carbon particles during dry mixing.

Figure 4:
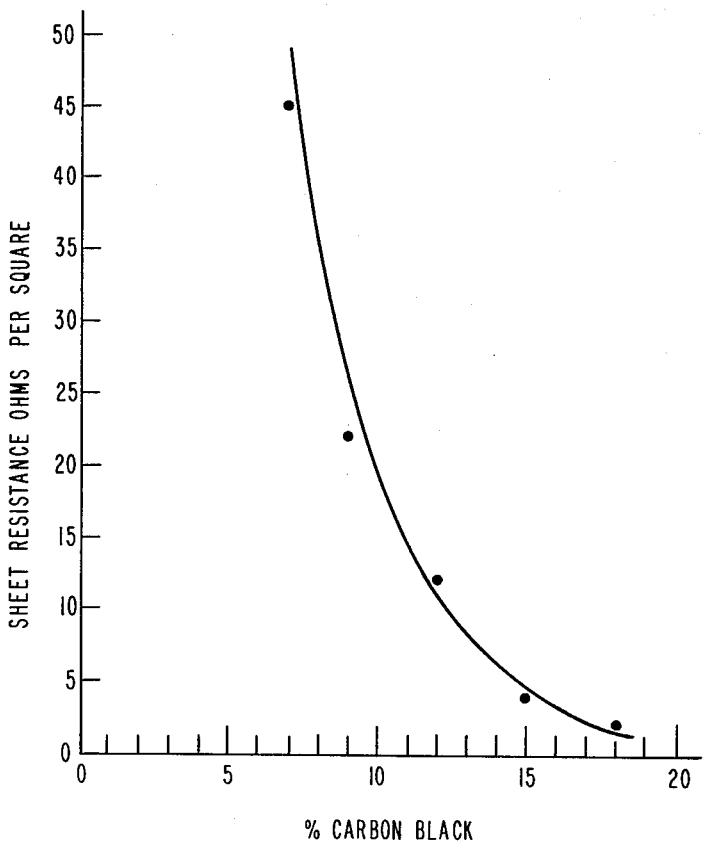
FIG. 4 is a diagram of sheet resistance versus carbon content of thermoplastic compositions in accordance with the invention.

In accordance with the invention, sheet resistance of a conducting thermoplastic material may be conveniently specified to be less than or equal to a value $y=60{,}000/x^3$ or even less than or equal to $y=40{,}000/x^3$, where x denotes carbon content in weight percent and where y is in units of ohm per square. These limits are in agreement with test results as graphically depicted in FIG. 4 and as obtained from specimens having, respectively, 7, 9, 12, 15, and 18 weight percent carbon. Preparation and testing of specimens are more specifically illustrated by the following examples.

EXAMPLE 1

Ingredients for electrically conducting ABS were measured as follows: 1800 gm ABS (Cycolac T), 180 gm carbon black (Ketjen), 5 gm oil devasilina, 5 gm G-30 lubricant, and 10 gm G-70 lubricant. ABS and carbon black were mixed dry in a Welex mixer at high speed for 3 minutes. Speed was then reduced, the oil devasilina was added, and mixing continued for 1 minute. The mixer was stopped, solid lubricants G-30 and G-70 were added, and mixing continued at high speed for 2 minutes. The resulting powder was loaded into a screw extruder, fluxed at a temperature of approximately 200 degrees C., and extruded; the extruded material was chopped into granules. The granules were loaded into a compression press, heated to a temperature of approximately 240 degrees C., and the material was pressed into the shape of a disc having a diameter of 6.25 cm and a thickness of 0.25 cm. After cooling to room temperature, the disc was trimmed into a square having sides of 4.25 cm. A four-point probe system (as described by M. A. Logan, "An AC Bridge for Semiconductor Resistivity Measurements Using a Four-Point Probe", *Bell System Technical Journal*, Vol. 40 (1961), pp. 885–919) was used to measure sheet resistance at a number of points on each sample. Sheet resistance of samples was found to be safely within a tolerance of plus or minus 5 percent.

EXAMPLE 2

Samples were made as described above in Example 1 except that fluxing was by pouring the dry-mixed powder onto a two-roll mill. The sheet exiting from the mill was chopped and processing continued as described above.

What is claimed is:

1. Electret microphone comprising a molded thermoplastic component of which at least a portion is electrically conducting, the material of said at least a portion consisting essentially of an acrylonitrile butadiene styrene copolymer resin and carbon particles, carbon being contained in said material in a percentage by weight which is here designated as x and which is in the range of 5–20 weight percent of said material, and said material having electrical sheet resistance which, in the absence of surface metallization, is less than or equal to a value of $60{,}000/x^3$ ohm per square.

2. Electret microphone of claim 1 in which said material comprises said resin and said carbon particles in a combined amount of at least 98 weight percent of said material.

3. Electret microphone of claim 1 in which carbon is contained in said material in a percentage x which is in the range of 7–12 weight percent of said material.

4. Electret microphone of claim 1 including an electrically nonconducting thermoplastic component which consists essentially of an acrylonitrile butadiene styrene copolymer resin and which is attached to said electrically conducting thermoplastic material.

5. Electret microphone of claim 4 in which said nonconducting thermoplastic material is attached to said electrically conducting thermoplastic material by two-shot molding.

* * * * *